US010703536B2

(12) United States Patent
Brantley

(10) Patent No.: US 10,703,536 B2
(45) Date of Patent: Jul. 7, 2020

(54) STACKABLE STORAGE DEVICE FOR FOOTWEAR

(71) Applicant: Kellen Brantley, Miami, FL (US)

(72) Inventor: Kellen Brantley, Miami, FL (US)

( * ) Notice: Subject to any disclaimer, the term of this patent is extended or adjusted under 35 U.S.C. 154(b) by 0 days.

(21) Appl. No.: 16/265,860

(22) Filed: Feb. 1, 2019

(65) Prior Publication Data

US 2019/0168913 A1 Jun. 6, 2019

Related U.S. Application Data

(63) Continuation-in-part of application No. 15/661,833, filed on Jul. 27, 2017, now Pat. No. 10,273,075.

(51) Int. Cl.

| | |
|---|---|
| ***B65D 85/18*** | (2006.01) |
| ***B65D 21/02*** | (2006.01) |
| ***B65D 43/22*** | (2006.01) |
| ***B65D 43/16*** | (2006.01) |
| ***A47B 47/00*** | (2006.01) |
| ***A47B 87/00*** | (2006.01) |
| ***A47F 7/08*** | (2006.01) |
| ***A47B 87/02*** | (2006.01) |
| ***A47B 61/04*** | (2006.01) |

(52) U.S. Cl.

CPC ..... *B65D 21/023* (2013.01); *A47B 47/0091* (2013.01); *A47B 61/04* (2013.01); *A47B 87/007* (2013.01); *A47B 87/0207* (2013.01); *A47B 87/0284* (2013.01); *A47F 7/08* (2013.01); *B65D 43/167* (2013.01); *B65D 43/22* (2013.01); *B65D 85/187* (2013.01)

(58) Field of Classification Search

CPC .... B65D 85/18; B65D 21/023; B65D 43/166; B65D 43/24; A45C 11/00

USPC ..... 206/738

See application file for complete search history.

(56) References Cited

U.S. PATENT DOCUMENTS 5,683,030 A * 11/1997 Moore ..... B65F 1/0053 206/459.5
5,709,304 A * 1/1998 Credle, Jr. ..... A63H 33/086 206/501
7,866,768 B2 * 1/2011 Mallouk ..... A47B 87/0292 312/107.5

* cited by examiner

*Primary Examiner* — King M Chu

(74) *Attorney, Agent, or Firm* — Russell D. Nugent; The Humphries Law Firm, P.C.

(57) ABSTRACT

A display case assembly for footwear that allows the user easy access to each individual pair of footwear while displaying each item of footwear. The assembly includes one or more containers that can be stacked to form an assembly of storage devices that cooperate to assist access to the footwear in that a first device stacked on top of a second device can be used to hold the door of the second device open while the user accesses the footwear inside. The containers feature two adjacent doors with magnets located on their exterior surfaces positioned to contact the magnets on a door of a second container stacked on top of a first container. In addition, the containers feature a support column with magnets that are positioned to contact magnets on the doors when the doors are fully closed.

14 Claims, 4 Drawing Sheets

STACKABLE STORAGE DEVICE FOR FOOTWEAR

CROSS-REFERENCE TO RELATED APPLICATIONS

This application claims the benefit of priority to U.S. Provisional application Ser. No. 15/661,833 filed on Jul. 27, 2017. The content of U.S. Provisional application Ser. No. 15/661,833 filed on Jul. 27, 2017 is incorporated by reference in its entirety.

BACKGROUND OF THE INVENTION

(a) Field of the Invention

The present invention is in the technical field of apparel storage devices. More particularly, the present invention is in the technical field of storage devices for footwear.

(b) Background Art

Archeologists posit the first footwear was developed approximately 40,000 years ago with the earliest known examples consisting of sandals made from bark. Ancient While the ancient Greeks did not always see the need for footwear, the Romans considered it a sign of civility. They also began making different shoes for each foot. Fast forward a few thousand years and ancient forms of footwear are still available to modern people. Not only are sandals still in common use, but the modern loafer is styled after the moccasin and the flip-flop after thong sandals first used by the Egyptians.

Anything that has been around for 40,000 years is bound to develop admirers and footwear is no different. Sneaker enthusiasts became part of modern American culture around the time Michael Jordan's Air Jordans were introduced in 1985. Some so-called "sneakerheads" collect shoes out of feelings of nostalgia, others to be fashionable or to stand out. Others like to collect shoes made by high end fashion designers like Louis Vuiton. A lot of Americans enjoy collecting vintage shoes from just about any era. Collectors help to support an industry worth more than 95 billion dollars worldwide.

Collectors currently need a better storage option. Most modern footwear storage containers are not meant to display shoes at all. They are largely designed to conserve space, keep collections of shoes organized and protect shoes from dirt and debris. Most consist of either a slidable drawer or an open-faced cavity into which the shoes are placed. Display cases for shoes are generally designed for either commercial use or for collectors. In the case of the former, the display cases are large and unwieldy, expensive and usually consist of shelves inserted into a glass cabinet to accommodate several pairs of shoes in one enclosed space. On the other hand, collectors' cases are usually glass or plastic cubes such as those used to mount baseballs and other memorabilia. Those devices are not designed to be easy to frequently access. Frequent access may be a problem somewhat unique to shoe collectors as shoe collectors often wear their collectables rather than just displaying and storing them.

As a result, there is a need for an improved storage device for footwear that allows the user to display their collection in a dust and dirt-free environment in devices that can be stacked one on top of another and still allow the user to conveniently access the entire collection.

BRIEF SUMMARY OF THE INVENTION

The present invention is a display case for clothing that protects each item from dust and damage while providing an attractive display case. More specifically, the present invention is a display case for footwear, including but not limited to shoes, boots, sandals and the like; although, the device is suitable for storage of other clothing items including but not limited to shorts and pants. In addition, the present invention is a display case for footwear that allows the user easy access to each individual pair of footwear while displaying each item of footwear. The devices can be stacked to form an assembly of storage devices that cooperate to assist access to the footwear in that a first device stacked on top of a second device can be used to hold the door of the second device open while the user accesses the footwear inside. The stackable storage device also allows the user to access the footwear from more than one direction or angle.

Each individual storage device is made of a container that is preferably translucent if not transparent. While the storage container could be made of opaque materials, doing so would limit its ability to display the items container therein. The storage container described in this application generally consists of a container having a top surface, a bottom surface, one or more side surfaces and one or more movable doors operably connected to the storage device. Preferred embodiments of this storage container feature at least two sidewalls. Other preferred embodiments of the presently disclosed storage container feature a top surface, a bottom surface, two sidewalls, and two doors connected to either the top surface or the bottom surface with hinges. In preferred embodiments and the anticipated best mode of the storage container, a support column connects the top surface and the bottom surface at a corner where the two doors meet. Alternately, the movable doors could be located at opposite ends of the container.

There are other structures in the various embodiments of the device that both facilitate and take advantage of stacking of the devices one on top of the other. While not necessary to this function, it is desirable to include protrusions on the exterior of the device that engage with openings or holes located on the exterior of a second device. In preferred embodiments, there are protrusions located on the top surface of the device that are sized and positioned to engage holes featured in the bottom surface of a second device. The holes traverse the bottom surface of the device from the interior to the exterior of the device and allow the protrusions on the first device to engage with the second device such that the second device supports the first device. Other structures can be used to accomplish the same end, i.e. engaging the two devices to prevent the first or top device from falling or sliding off of the bottom or second device. For example, one device could feature slots on an exterior surface—either the top or the bottom surface—of the container; those slots being configured to accommodate or engage with ridges or protrusions on a corresponding surface of another device. In this manner, any number of devices could be stacked one on top of the other to form an assembly of storage devices.

The configuration of the devices also allows the devices to cooperate to make access to the individual pieces of footwear more convenient. In preferred embodiments and the anticipated best mode of the device, each door features a magnet. When the devices are stacked one on top of the other and a user opens one of the doors of the device, the magnet on the door being opened is positioned to contact the magnet on the door of the device stacked on top of it. That way, the magnet on the door of the device stacked on top can hold the door of the device below it open while the user accesses the contents. This configuration requires that the door feature hinges close to or integrated into the top surface of the container such that the lower surface of the door (the surface closest to the bottom surface of the container) is the free end of the door that can be lifted to reveal the opening in the container. Other embodiments can feature the hinge on the bottom edge of the door.

Other preferred embodiments of the container feature a magnet that is located on the column that connects the top surface of the container with the bottom surface of the container near where the two doors meet. These embodiments can also feature an additional magnet on the door positioned to come into contact with the magnet on the column thereby allowing the magnets to help close and secure the door when they are in a closed position. In addition, preferred embodiments of the device include containers of differing size to accommodate different sizes of footwear. These embodiments can also feature one or more magnets on or integrated into the surface of the door. In preferred embodiments and the anticipated best mode of the device, the shorter containers have a single magnet on their door positioned to interact with a magnet on a second door while the larger containers have two magnets featured on their doors. The two magnets are positioned such that at least one of them contacts the magnet of a container stacked on top of it. Spacing the magnets apart on the doors of the larger containers allows the magnet to interact with a magnet on the device above it regardless of whether that container is the same size or smaller.

A variety of structures other than magnets can be used to allow the door to engage with and temporarily adhere to the bottom surface of the container stacked above. For example, the exterior of the door could be equipped with a fastening component of a hook and loop fastener system while the complementary fastening component of the same hook and loop fastener system could be located on the exterior of the bottom surface of the container stacked above. Similarly, hooks and grooves, and other conventional fasteners could be employed to accomplish the same end.

Moreover, preferred embodiments and the anticipated best mode of the device include magnets features on the top and bottom surfaces of the containers either integrated into the protrusions or other structures such that the magnets are in contact when the containers are stacked on top of each other providing further means of securing one container to the other.

BRIEF DESCRIPTION OF THE SEVERAL VIEWS OF THE DRAWING(S)

DETAILED DESCRIPTION OF THE INVENTION

Figure 1:
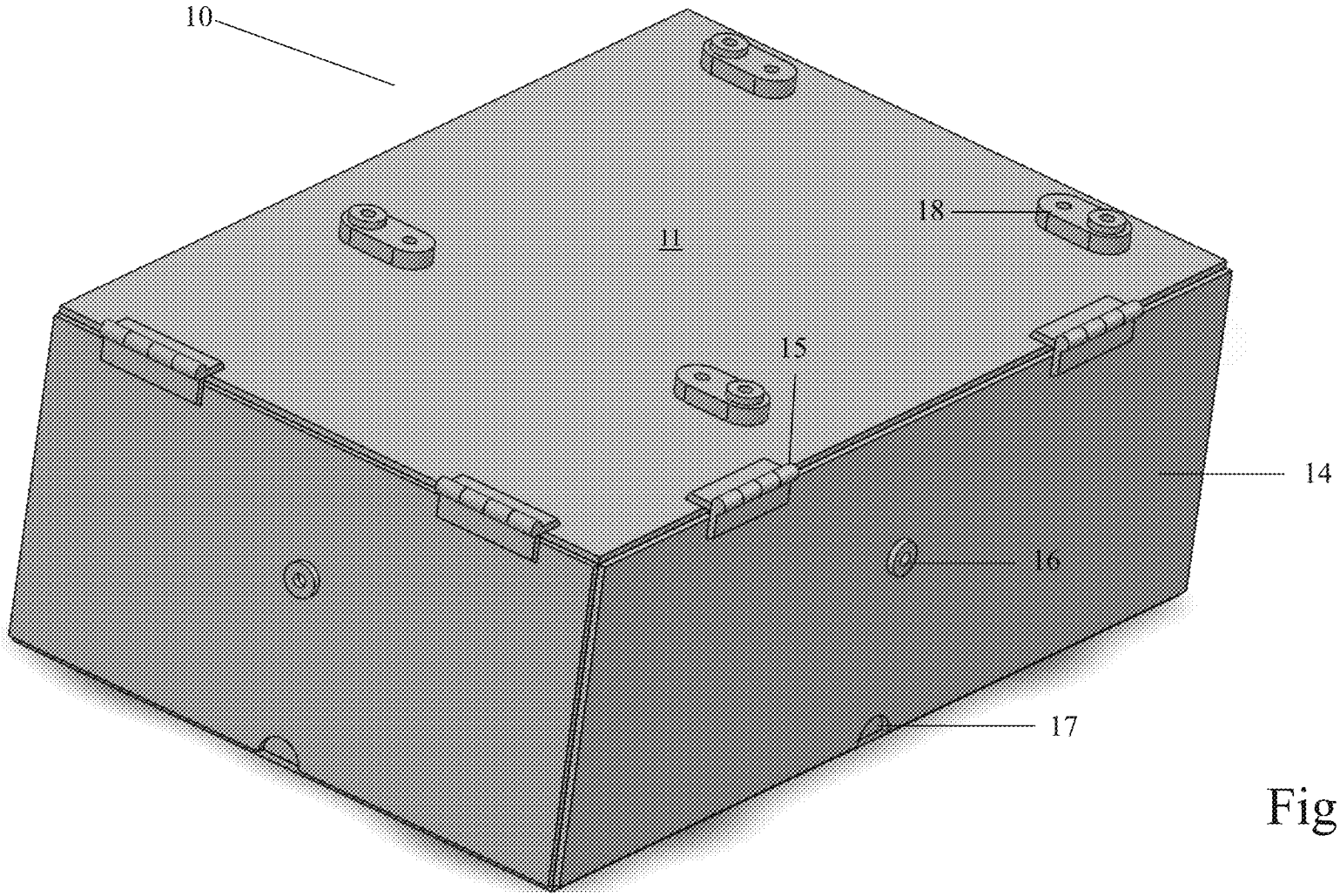
FIG. 1 is a top perspective view of a preferred embodiment of the stackable storage device.
Figure 2:
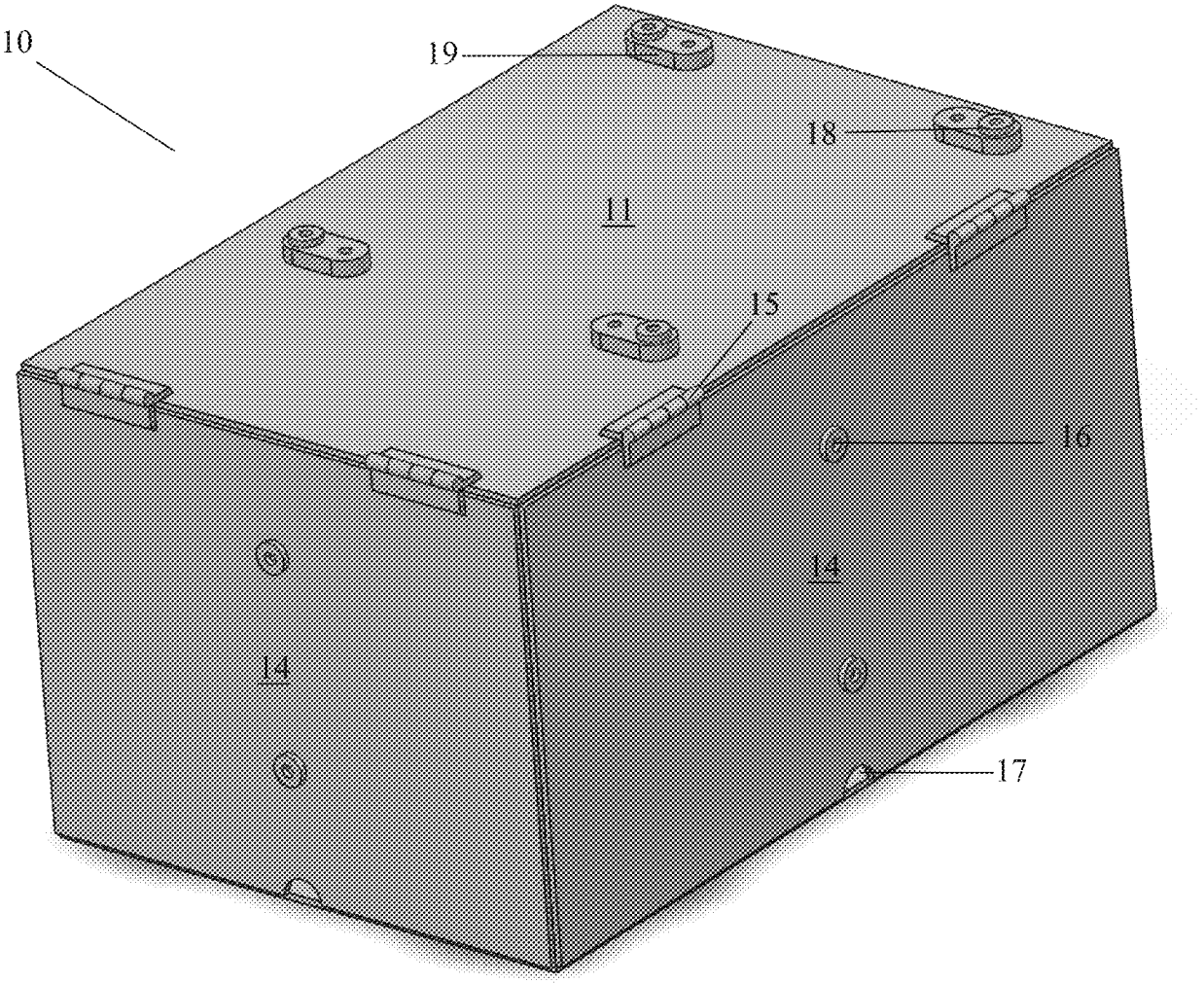
FIG. 2 is a side perspective view of a preferred embodiment of the present invention.

FIGS. 1 through 4 show a preferred embodiment and the anticipated best mode of the stackable storage device for footwear. Specifically, FIGS. 1 and 2 show different angles of the stackable storage device made of a container 10 having a top surface 11, a bottom surface (not shown), two sidewalls (not shown), two movable doors 14 attached to the top surface 11 via hinges 15 and featuring at least one magnet 16 in each door's center. In addition, FIG. 1 shows a cutout 17 featured at the bottom surface of each door that allows a user to more easily open the door 14 to which it is attached. Said cutouts 17 can be featured on a number of different parts of the door 14 as its function is to allow the user a handhold to grip the edge of the door 14 so as to apply enough force to open the door.

FIGS. 1 and 2 also show some of the structures that make the containers easier to stack, specifically, the top surface 11 of reach container 10 features one or more protrusions 18 that are sized and positioned to fit into cavities (not shown) on the bottom surface of another container. In some preferred embodiments and the anticipated best mode of the device, the top surface 11 of the container 10 features feet 19 made of a slip resistant material and each of the feet 19 features a raised protrusion 18 extending up and away from the top surface 11 of the foot 19 to which it is attached. Still further preferred embodiments can feature a magnet 16 integrated into the feet 19 or top surface 11 of the container 10 meant to interact with one or more magnets (not shown) on the bottom surface (not shown) of another container (not shown). FIGS. 1 and 2 also shows a magnet 16 featured by each of the two doors 14 of the container.

Figure 3:
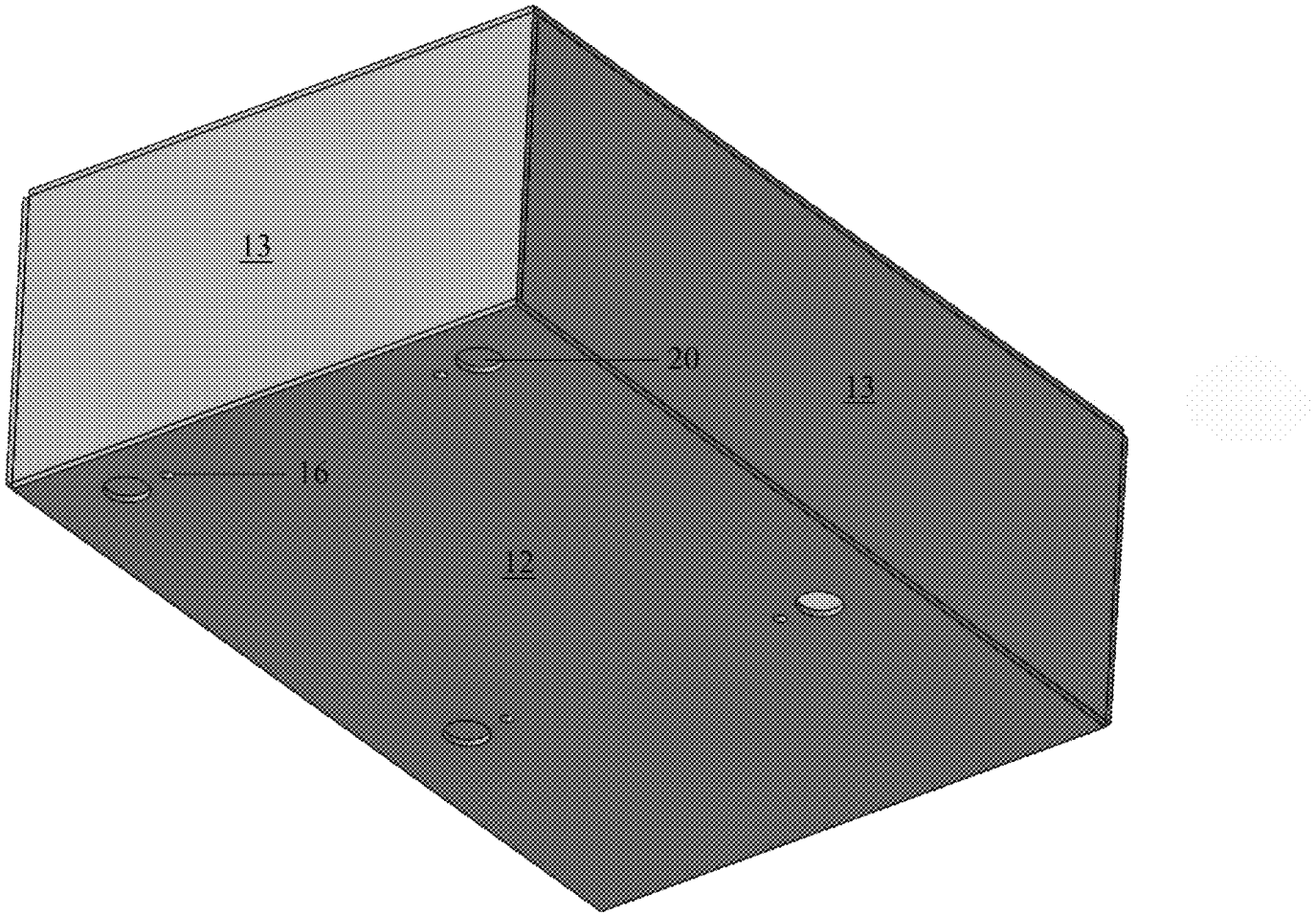
FIG. 3 is a bottom perspective view of a preferred embodiment of the present invention.

FIG. 3 shows the sidewalls 13 featured by each container. Preferred embodiments and the anticipated best mode of the device include at least two sidewalls 13 located adjacent to each other. However, other embodiments can include up to four doors integrated into the device such that the user can access the stored footwear from any of four directions.

FIG. 3 also shows the bottom surface 12 of a container according to a preferred embodiment of the device. Note, the bottom surface features one or more cavities 20 into which a protrusion (not shown) on the top surface (not shown) of a separate container (not shown) can be inserted. In addition, FIG. 3 also shows the positioning of more magnets 16 on the bottom surface of the container 10. These magnets 16 can be positioned to engage with additional magnets (not shown) on the top surface (not shown) of a separate container (not shown).

Figure 4:
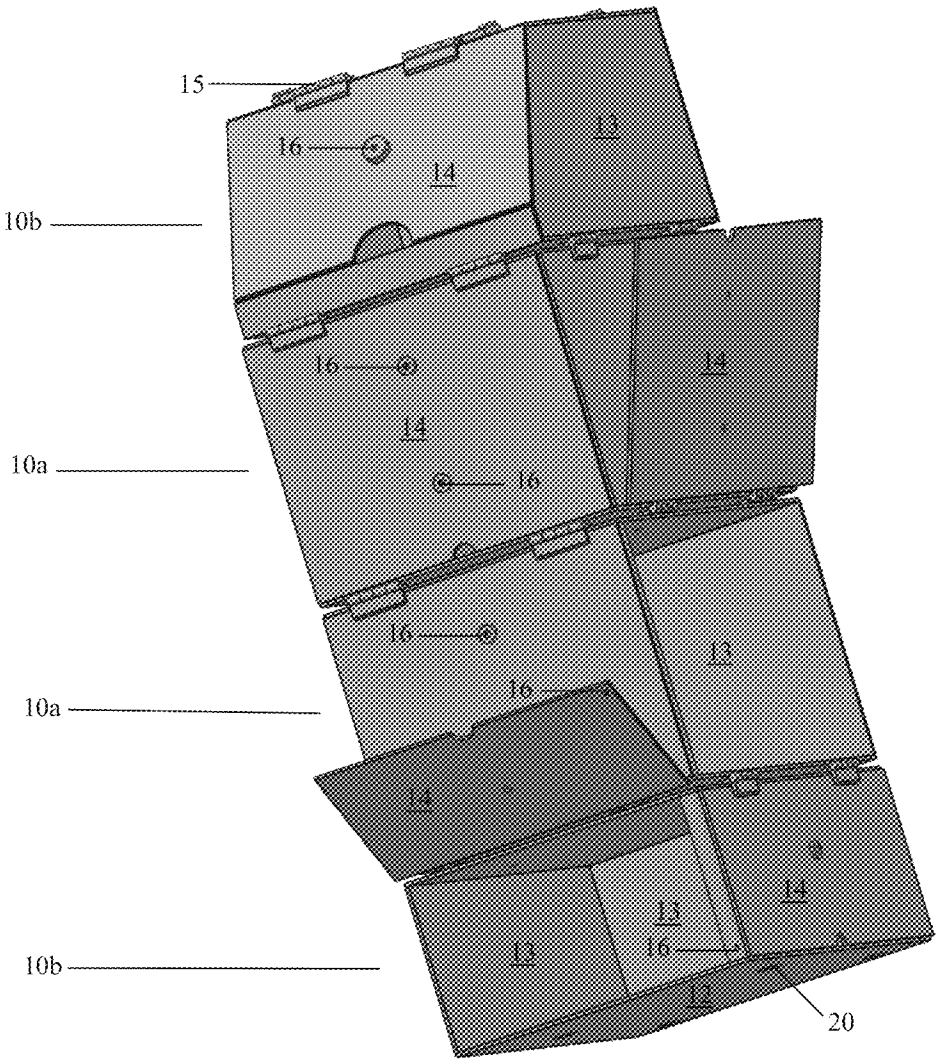
FIG. 4 is a side perspective view of an assembly of containers according to the present invention.

FIG. 4 illustrates how the containers interact when they are stacked one on top of the other according to a preferred embodiment of the device. Specifically, FIG. 4 shows four containers 10 stacked on top of each other. Each container features a top surface (not shown), a bottom surface 12, a plurality of sidewalls 13 and a plurality of doors 14 connected to the top surface by hinges 15. Each door 14 features one or more magnets 16. Note FIG. 4 shows two of larger containers 10*a* stacked in between two of the smaller containers 10*b*. Also note, the magnets 16 on the doors 14 of the larger containers 10*a* are positioned such that they can contact the magnets 16 on the door of another larger container 10*a* or the magnet 16 that is present on the door of a smaller container 10*b*.

FIG. 4 also shows the support column 21 that is featured by some preferred embodiments and the anticipated best mode of practicing the invention. The column connects the top surface 11 and the bottom surface 12 at a corner where the two adjacent doors 14 come together. Said column 21 provides support to the top surface 11 that does not depend on the movable doors 14. As discussed above, the column 21 can feature a magnet 16 that is positioned to interact with another magnet 16 located on an inside surface of the same container's 10 door 14. When the door 14 is closed, the additional magnet 16 contacts with magnet 16 on the column 21 providing additional means of keeping the door 16 in a closed position. FIG. 4 also shows the cavities 20 present on the bottom surface 12 of each container 10. Each cavity 20 is configured to receive a protrusion 18 and/or the foot 19 positioned on the top surface 12 of a container 10 stacked underneath.

The advantages of the present invention include, without limitation, the ability to both display clothing such as footwear while protecting each item from dust and damage and allowing the user easy access to each individual pair of footwear while displaying each item of footwear. Further, the devices when stacked one on top of the other devices assist each other in holding the door to the opening open, making access to the footwear more convenient.

Reference throughout the specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout the specification may, but do not necessarily, refer to the same embodiment.

Furthermore, the described features, advantages, and characteristics of the invention may be combined in any suitable manner in one or more embodiments. One skilled in the relevant art will recognize that the invention can be practiced without one or more of the specific features or advantages of a particular embodiment. In other instances, additional features and advantages may be recognized in certain embodiments that may not be present in all embodiments of the invention.

It is understood that the above described embodiments are only illustrative of the application of the principles of the present invention. The present invention may be embodied in other specific forms without departing from its spirit or essential characteristics. The described embodiment, including the best mode, is to be considered in all respects only as illustrative and not restrictive. The scope of the invention is, therefore, indicated by the appended claims, if any, in conjunction with the foregoing description.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above described embodiment, method, and examples, but by all embodiments and methods within the scope and spirit of the invention.

I claim:

1. A stackable storage device for footwear comprising:

a container having a top surface, a bottom surface, a plurality of sidewalls, two doors each located adjacent to each other and connected to the top surface of the container; at least one magnet featured on the plurality of movable doors and a support column connecting the top surface and the bottom surface, said support column positioned at the intersection of the two doors that are located adjacent to each other; and wherein each of the two doors is located opposed to at least one sidewall.

2. The storage device of claim 1 further comprising at least one first magnet featured on a surface of the column, at least one second magnet located on an inside surface of at least one door wherein the at least one second magnet is positioned to contact the at least one first magnet on the column when the door is closed.

3. The storage device of claim 2 further comprising at least one protrusion featured by the top surface of the container and at least one cavity featured by the bottom surface of the container wherein the protrusions on a first container and configured to insert into the holes of a second container when the second container is stacked on top of the first container.

4. The storage device of claim 3 further comprising at least one magnet on the bottom surface of the second container and at least one magnet featured on the top surface of the first container; said magnets being positioned such that they are in contact when the second container is stacked on top of the first container.

5. The stackable storage container of claim 1 wherein each door features a magnet.

6. A stackable storage assembly for footwear comprising:

a plurality of containers stacked one on top of the other and each having a top surface, a bottom surface, at least one sidewall and at least one moveable door;

wherein at least one container features two doors that are located adjacent to each other and each door is located opposed to at least one sidewall; and wherein each top surface features at least one protrusion that is complementary to and able to fit into a cavity located on each bottom surface of each of the plurality of containers;

and wherein each door of each of the plurality of containers features a first magnet and wherein the first magnet of a first container of the plurality of containers is positioned to come into contact with the first magnet featured by the door of a second container of the plurality of containers when it is stacked on top of the first container of the plurality of containers when the door of the first container is fully opened.

7. The stackable storage assembly of claim 6 wherein each of the doors of the plurality of containers features a second magnet and wherein the second magnet of a first container is positioned to contact the first magnet on the door of a second container stacked on top of a first container when each of the doors is fully opened.

8. The stackable storage assembly of claim 7 wherein the second container is smaller than the first container.

9. The stackable storage assembly of claim 6 wherein each of the plurality of containers features a support column with a first end and a second end, said first end being in contact with the bottom surface of its respective container and the second end is in contact with the top surface of its respective container.

10. The stackable storage assembly of claim 9 wherein the support column in each of the plurality of containers is positioned such that a first surface of the support column is in contact with one of the two doors and a second surface of the support column is in contact with a second door; and wherein the first side of each assembly features a third magnet and the second side features a fourth magnet.

11. The stackable storage assembly of claim 10 further comprising a fifth magnet being located on each door and positioned such that the fifth magnet is in contact with the third or fourth magnet featured by the support column when each door is fully closed.

12. A stackable storage assembly comprising:

at least two containers stacked on top of each other, each container having a top surface, a bottom surface, a first sidewall and a first door located at opposing ends of the container, and a second sidewall and a second door located opposite the second sidewall;

wherein each door features a first magnet, a second magnet, and a third magnet;

a support column that connects the top surface to a bottom surface and is located a corner of the container where the first door and the second door meet; wherein said support column features a fourth magnet and a fifth magnet;

wherein the first magnet or the second magnet on each door is positioned to come into contact with the first magnet or the second magnet of the door on the container stacked on top of it when fully opened; and the third magnet on each door is positioned to be in contact with either the fourth magnet or the fifth magnet on the support column when the door is in a closed position.

13. The stackable storage assembly of claim 12 wherein each top surface features at least one protrusion that is complementary to and able to fit into a cavity located on each bottom surface of each of the at least two containers.

14. The stackable storage assembly of claim 13 further comprising at least one magnet on the bottom surface of one of the at least two containers and at least one magnet featured on the top surface of the other of the at least two containers; said magnets being positioned such that they are in contact when the containers are stacked on top of one another.

* * * * *